US008174140B2

(12) United States Patent
Kanai et al.

(10) Patent No.: US 8,174,140 B2
(45) Date of Patent: May 8, 2012

(54) MULTIPURPOSE ENGINE HAVING ELECTRICAL WIRING CONNECTED INSIDE CONNECTOR BOX

(75) Inventors: Mitsuyoshi Kanai, Wako (JP); Souhei Honda, Wako (JP); Akihisa Shinoda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 581 days.

(21) Appl. No.: 11/922,577

(22) PCT Filed: Jun. 16, 2006

(86) PCT No.: PCT/JP2006/312557

§ 371 (c)(1),
(2), (4) Date: Aug. 5, 2009

(87) PCT Pub. No.: WO2006/137503

PCT Pub. Date: Dec. 28, 2006

(65) Prior Publication Data

US 2009/0302610 A1 Dec. 10, 2009

(30) Foreign Application Priority Data

Jun. 23, 2005 (JP) ..... P2005-183057

(51) Int. Cl.
*F02B 63/04* (2006.01)

(52) U.S. Cl. ..... 290/47

(58) Field of Classification Search ..... 290/47
See application file for complete search history.

(56) References Cited

U.S. PATENT DOCUMENTS

| | | | | |
|---|---|---|---|---|
| 4,136,432 | A * | 1/1979 | Melley, Jr. | 29/469 |
| 5,925,851 | A * | 7/1999 | Sugahara | 174/662 |
| 6,028,369 | A * | 2/2000 | Hirose et al. | 290/1 A |
| 6,091,160 | A * | 7/2000 | Kouchi et al. | 290/1 A |
| 6,525,430 | B1 * | 2/2003 | Asai et al. | 290/1 A |
| 6,917,121 | B2 * | 7/2005 | Akimoto et al. | 290/1 A |
| 6,975,042 | B2 * | 12/2005 | Yamada et al. | 290/1 R |
| 7,045,911 | B2 * | 5/2006 | Kirkpatrick et al. | 290/1 R |
| 7,335,035 | B2 * | 2/2008 | Shirota | 439/76.2 |
| 7,499,263 | B2 * | 3/2009 | Herbstritt et al. | 361/637 |
| 7,642,665 | B2 * | 1/2010 | Konop et al. | 290/1 A |
| 2002/0047689 | A1 * | 4/2002 | Bessho et al. | 322/1 |
| 2003/0184094 | A1 | 10/2003 | Sodemann et al. | |

FOREIGN PATENT DOCUMENTS

| | | | |
|---|---|---|---|
| EP | 0 902 178 | A2 | 3/1999 |
| EP | 1 054 146 | A2 | 11/2002 |
| JP | 63154820 | A | 6/1988 |
| JP | 9-280071 | A | 10/1997 |
| JP | 2002-276514 | A | 9/2002 |

* cited by examiner

*Primary Examiner* — Joseph Waks
(74) *Attorney, Agent, or Firm* — Arent Fox LLP

(57) ABSTRACT

A multipurpose engine has a wiring structure between the generator and electrical components. A connector box is provided in a gap defined directly between the generator and the fuel tank. A plurality of electrical wirings is interconnected inside the connector box.

4 Claims, 13 Drawing Sheets

MULTIPURPOSE ENGINE HAVING ELECTRICAL WIRING CONNECTED INSIDE CONNECTOR BOX

TECHNICAL FIELD

The present invention relates to a structure of electrical wiring that is routed from the operating panel of an engine to an electrical component that includes a generator, a starter, a main switch, and the like.

BACKGROUND ART

This type of electrical wiring structure in a multipurpose engine has been proposed in Japanese Laid-open Patent Application No. 2002-276514, for example. This electrical wiring structure will be described based on FIG. 13.

In the electrical wiring structure 310 shown in FIG. 13, a starter 312, a rectifier 313, a magnet switch 314, a startup switch 315, and other electrical components are disposed on the lateral surface of the engine 311. These electrical components are connected to each other by electrical wiring 316.

In the electrical wiring structure 310, however, the electrical wiring 316 is laid out without being fixed to the lateral surface of the engine 311, and the electrical wiring is subjected to vibration from the operation of the engine 311.

When, for example, the magnet switch 314 is removed from the lateral surface of the engine 311 in this electrical wiring structure 310, the electrical wiring 316 is still attached to the engine 311, and maintenance of the electrical components is difficult to perform.

A multipurpose engine is therefore desired that eliminates the effects of vibration on the electrical wiring, and that has an electrical wiring structure in which the electrical components are easy to maintain.

DISCLOSURE OF THE INVENTION

Provided in the present invention is a multipurpose engine characterized in comprising an engine main body; a generator operated by the driving force of the engine; auxiliary components comprising a fuel tank, an air cleaner, a muffler, and other components disposed on the engine main body; an electrical component comprising a starter, a main switch, and the like; and a plurality of electrical wirings for connecting the generator and the electrical component to each other; wherein each of the plurality of electrical wirings is connected inside a connector box provided to the side of the engine main body and disposed in a gap formed between the engine main body and the auxiliary components.

Since the electrical wirings are thus interconnected inside the connector box in the engine of the present invention, the connections between electrical components can be concentrated within the connection box. As a result, the electrical components can be made easier to maintain, and repairs can be performed rapidly.

The connector box is preferably provided in a position that is adjacent to an operating panel on which the main switch is mounted. The condition of the electrical wiring can therefore be checked while the functionality of the main switch and other operating members is confirmed. This results in improved convenience during maintenance.

Retainers for retaining the plurality of electrical wirings are preferably provided to the connector box. Vibration of the electrical wiring is therefore easily prevented. This makes the connections between electrical components more reliable.

The multipurpose engine of the present invention is furthermore provided with a cooling fan provided coaxially with the output shaft of the engine main body, and a fan cover provided to the engine main body so as to cover the cooling fan, wherein the fan cover is integrally formed with the connector box. The electrical wiring structure of the multipurpose engine is thereby made more inexpensive.

BRIEF DESCRIPTION OF THE DRAWINGS

Certain preferred embodiments of the present invention will be described in detail below, by way of example only, with reference to the accompanying drawings, in which.

BEST MODE FOR CARRYING OUT THE INVENTION

Figure 1:
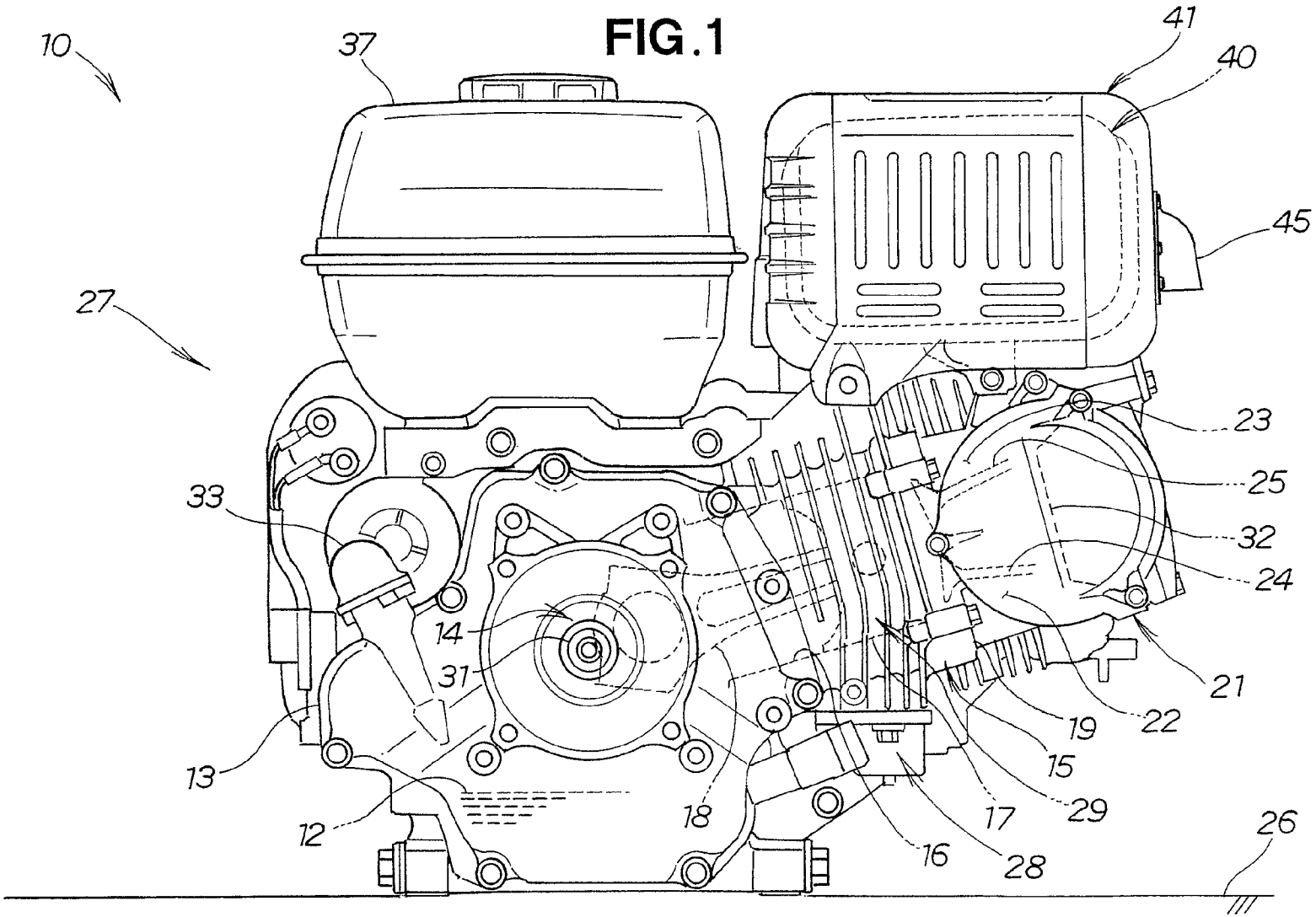
FIG. 1 is a front view of the multipurpose engine according to the present invention.
Figure 2:
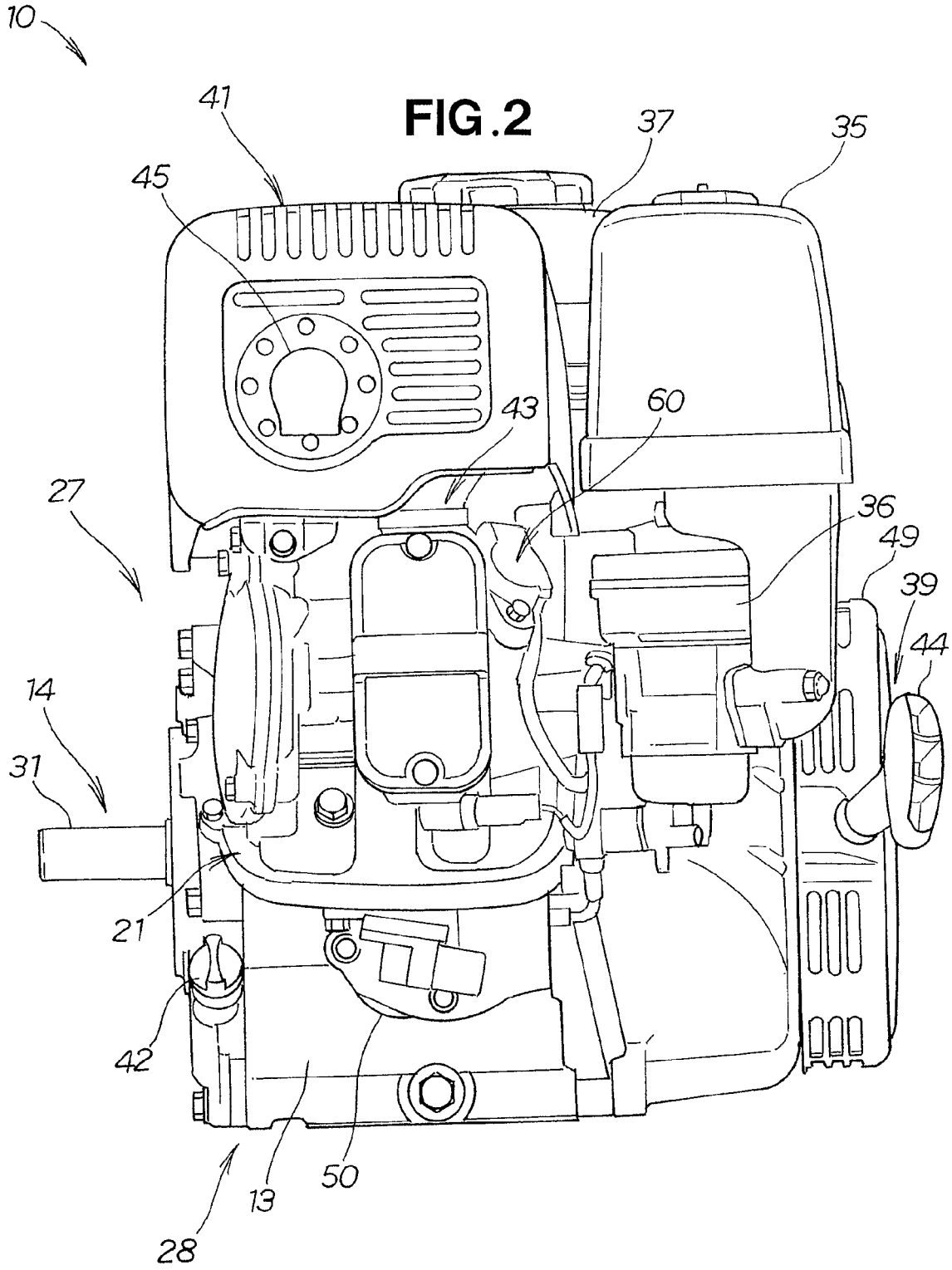
FIG. 2 is a side view of the multipurpose engine shown in FIG. 1.
Figure 3:
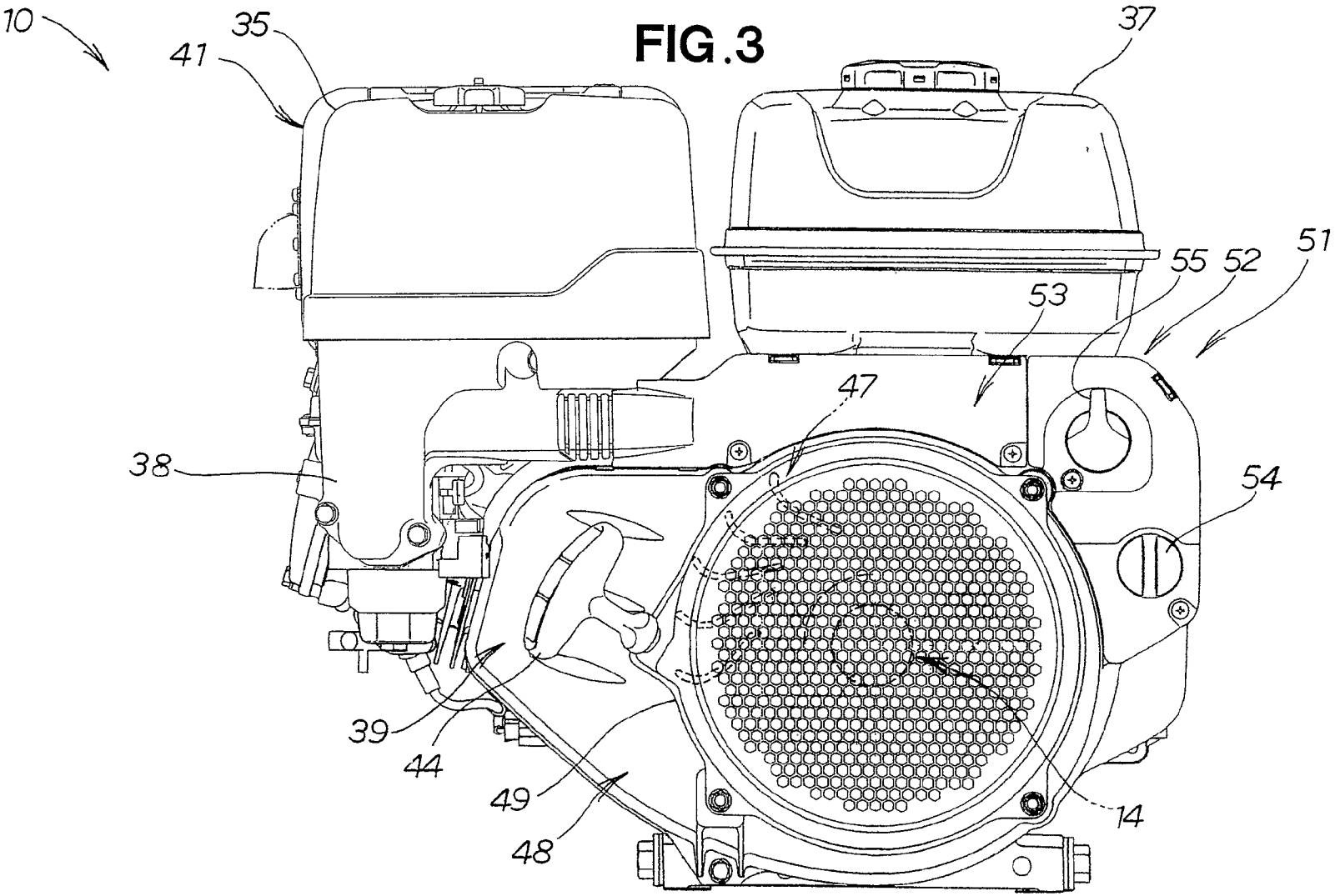
FIG. 3 is a rear view of the multipurpose engine shown in FIG. 1.

The multipurpose engine 10 shown in FIGS. 1 through 3 includes an engine main body 27 and auxiliary components that are composed of accessories for operating the engine main body 27. The auxiliary components primarily include an air cleaner 35 for drawing in outside air, a carburetor 36 for vaporizing fuel (gasoline) and feeding the fuel to a combustion chamber 29, a fuel tank 37 for storing the fuel, a muffler 40 for reducing the exhaust noise from the exhaust gas, a recoil starter 39 for starting the engine main body 27, an oil level detection device (oil alarm) 50 for detecting the oil level, a plug cap 60 that houses an ignition unit 204 (see FIG. 10) for performing ignition, and other components. The engine main body 27 shown in the drawings is an overhead-camshaft (OHC) air-cooled engine in which the cylinder is tilted.

The engine main body 27 is provided with a crankcase 13 for storing oil (lubricant) 12, a crankshaft 14 that is rotatably mounted parallel to the crankcase 13, a single-cylinder block 15 integrally formed with the crankcase 13 at an angle, a piston 17 that is slidably mounted to the cylinder 16 of the cylinder block 15, a connecting rod 18 for connecting the piston 17 and the crankshaft 14, a cylinder head 21 mounted to the open portion 19 of the cylinder block 15, an intake valve 24 provided to the intake port 22 of the cylinder head 21, and an exhaust valve 25 provided to the exhaust port 23 of the cylinder head 21.

The casing 28 is composed of the crankcase 13, the cylinder block 15, and the cylinder head 21. The combustion chamber 29 is composed of the cylinder block 15 and the cylinder head 21.

The crankshaft 14 has a power takeoff unit 31 at one end thereof. This power takeoff unit 31 is referred to as a power take-off (PTO).

The cylinder head 21 is provided with a valve movement chamber 32 for driving the intake valve 24 and the exhaust valve 25 through the rotation of the crankshaft 14.

Reference numeral 33 in the drawings indicates the oil level gauge. An exhaust pipe 45 for discharging the exhaust gas is mounted to the muffler cover 41.

As shown in FIG. 2, the oil is supplied from an oil supply vent 42. One end of the exhaust duct 43 extends from the cylinder head 21. The muffler 40 is mounted to the other end of the exhaust duct 43. The recoil starter 39 has a starting knob (grip) 44.

Figure 4:
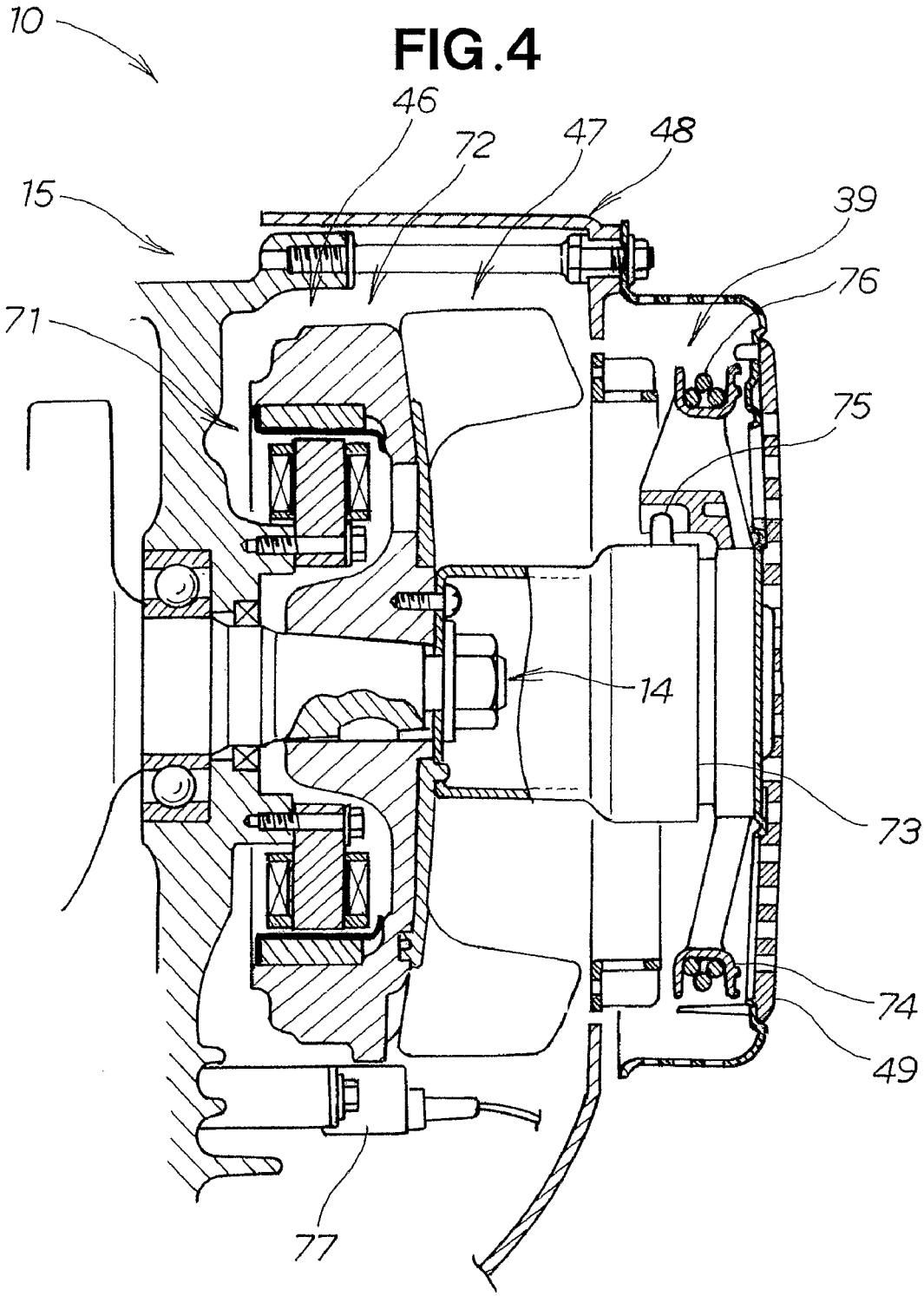
FIG. 4 is a side sectional view of the area around the generator of the multipurpose engine shown in FIG. 1.

As shown in FIGS. 3 and 4, the generator 46 and the cooling fan 47 are mounted on opposite sides of the power take-off 31 (see FIG. 1) of the crankshaft 14. The recoil starter 39 is covered by a recoil starter cover 49. A connecting duct (intake duct) 38 is connected to the air cleaner 35.

The generator 46 is composed of a starter 71 that is mounted to the cylinder block 15 on the side of the other end of the crankshaft 14, and a rotor 72 that is mounted to the crankshaft 14 around the starter 71 and has a pulse coil (rotation detection sensor) 77 for detecting the number of revolutions of the generator 46.

The cooling fan 47 is provided coaxially with the crankshaft (output shaft) 14, is mounted outside the rotor 72, and is covered by a fan cover 48 provided to the cylinder block 15.

The recoil starter 39 starts the engine main body 27. The starter is composed of a recoil starter cover 49 that is supported on the side of the cylinder block 15, a pulley 74 that is rotatably mounted to this recoil starter cover 49, a return spring (not shown in the drawing) that returns the pulley 74 to the initial state and is provided between the pulley 74 and the recoil starter cover 49, a latch 75 for meshing with a cup 73 during rotation of the pulley 74, a rope 76 wrapped on the pulley 74, and a starting knob 44 (see FIG. 3) mounted to the distal end of this rope 76. The cup 73 is mounted on the outside of the cooling fan 47.

An example of the electrical wiring structure 110 in the multipurpose engine 10 of the present invention will be described hereinafter with reference to FIGS. 5 through 12.

Figure 5:
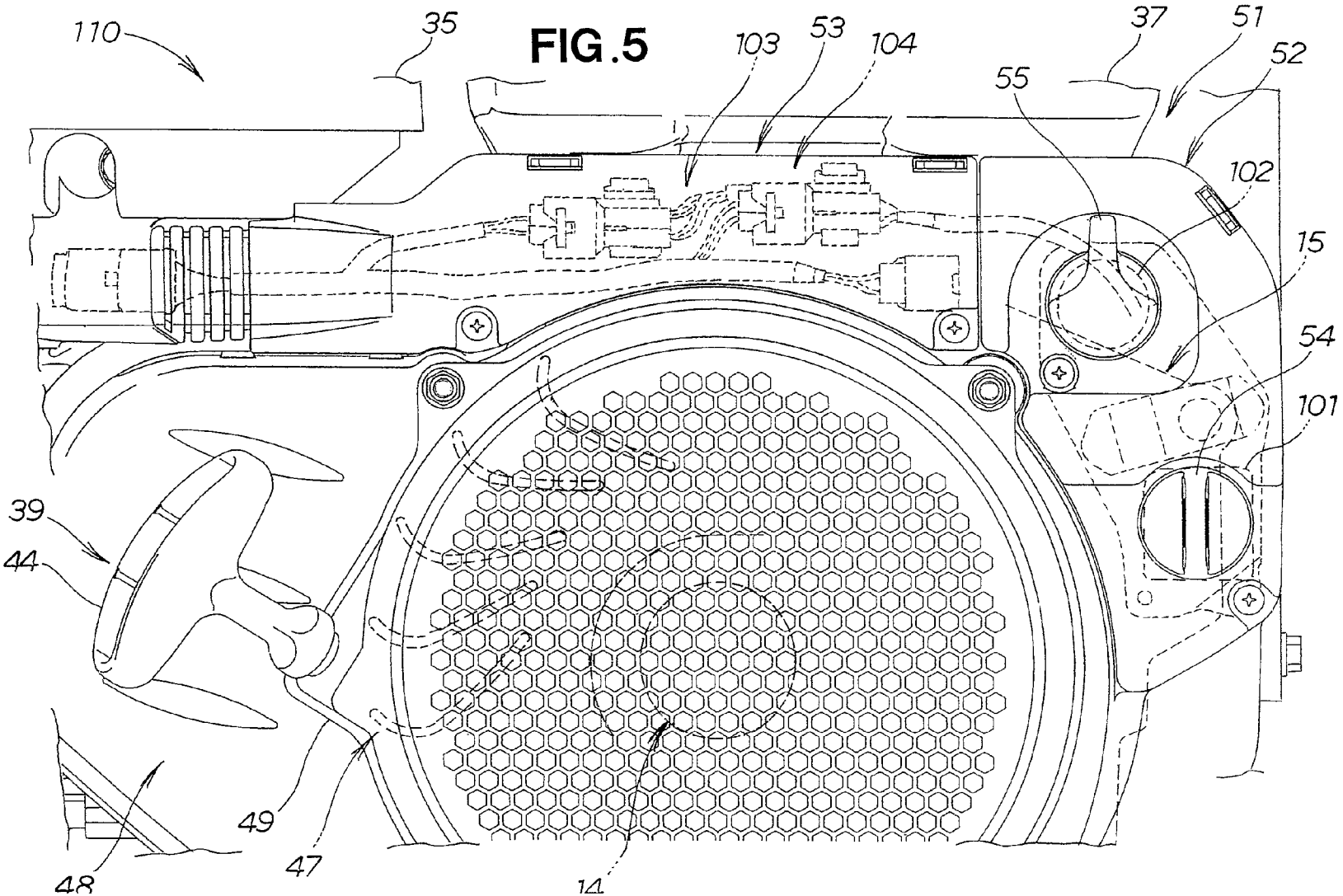
FIG. 5 is an enlarged view of FIG. 1.

As shown in FIG. 5, the fuel tank 37, the air cleaner 35, the muffler 40 (FIG. 1), and other auxiliary components are disposed above the cylinder block 15. An electrical wiring bundle 103 that is routed to the generator 46 (see FIG. 4) or to the main switch 101 or another electrical component is provided around the cylinder block 15.

The operating panel 51 is composed of a main panel 52 and a cover panel 53.

The main switch 101, volume 102, and other electrical components are arranged in the elongated main panel 52 formed from a resin. The main panel 52 is disposed on the upper side of the recoil starter cover 49.

A cover panel 53 formed from a resin covers the electrical wiring bundle 103. The cover panel 53 is connected to the main panel 52 and is provided between the fuel tank 37 and the recoil starter cover 49.

The main switch 101 is an electrical component for switching on the engine main body 27, and has a switch knob 54 for switching on the engine main body 27. The volume 102 is an electrical component for adjusting the characteristics of the governor motor 203 (FIG. 10) of the carburetor 36 (FIG. 2). The volume has an adjustment knob 55. The switch knob 54 and the adjustment knob 55 together constitute an operating member.

A fan cover 48 composed of a resin material is mounted on the engine main body 27 (FIG. 1) to cover and protect the cooling fan 47 (FIG. 5).

Figure 6:
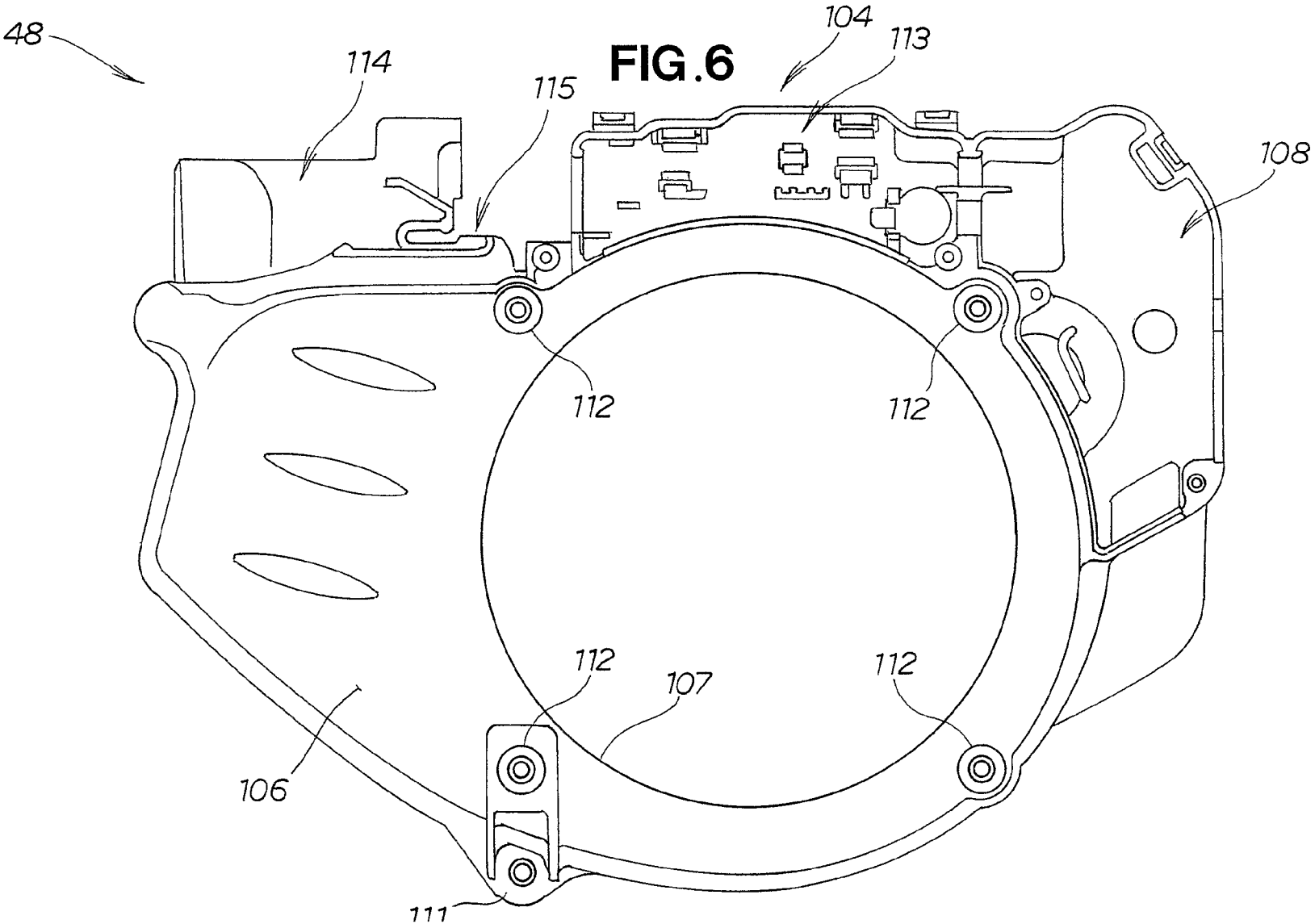
FIG. 6 is a front view of the fan cover of the multipurpose engine shown in FIG. 1.

As shown in FIG. 6, the fan cover 48 is composed of a partition wall 106 for partitioning the cooling fan 47 (FIG. 5) from the recoil starter 39 (FIG. 5), an opening 107 formed in the partition 106 in order to discharge hot air to the outside via the cooling fan 47, a connector box 104 that houses the electrical wiring bundle 103 (FIG. 5) and is provided to the top of the partition wall 106, and a housing 108 that is positioned beside the connector box 104 and encloses the main switch 101 (FIG. 5), the volume 102, and other electrical components.

The partition wall 106 is provided with a fastener 111 for fastening the partition wall 106 to the cylinder block 15 (FIG. 5), and a fixing boss 112 for securing the recoil starter cover 49 (FIG. 5).

The connector box 104 is provided with a first connector housing 113, and a second connector housing 114 that is separated from the first connector housing 113 by a substantially U-shaped open portion 115. The box forms a housing for the electrical wiring. The electrical wiring bundle 103 can be connected inside the connector box 104. The connector box 104 is detachable from the cover panel 53 (FIG. 5).

Since the connector box 104 is provided in integral fashion to the fan cover 48, the cost of the structure can be reduced.

Figure 7A:
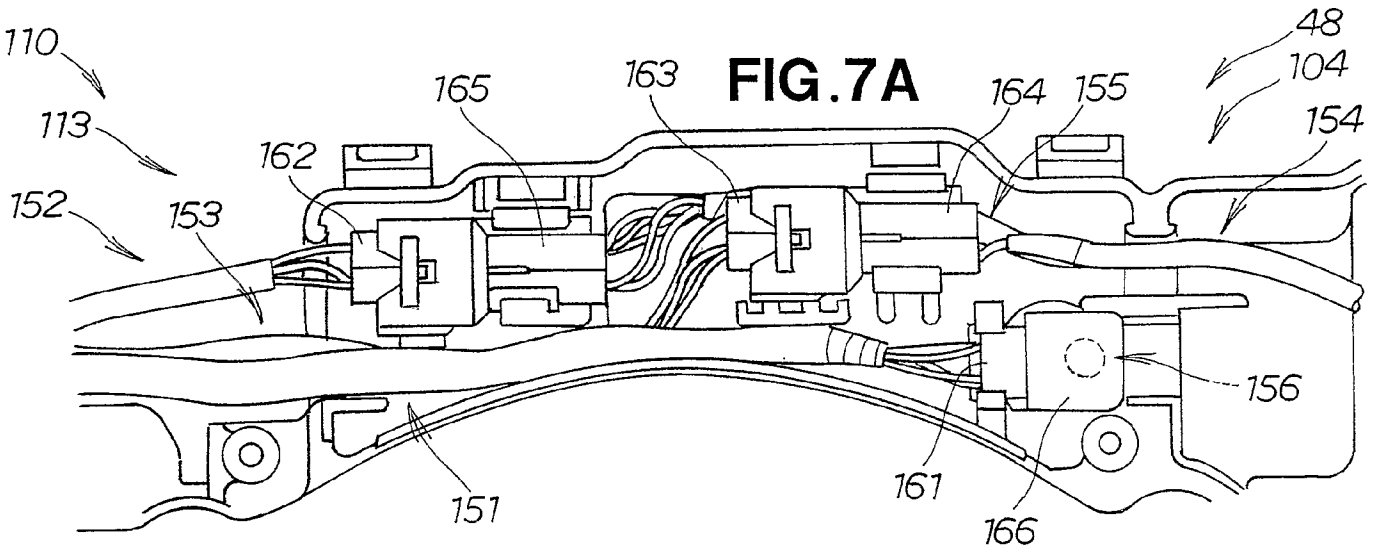
FIG. 7A is a plan view showing only the first connector terminal.

As shown in FIG. 7A, the first connector housing 113 is designed so as to be capable of enclosing harnesses 151, 152, 153, 154, 155, and 156. [The first connector housing 113] is a part that allows for connection or disconnection of these harnesses 151 through 156. The first harness 151 extends from the side of the carburetor 36 (FIG. 2). The second harness 152 is branched from the first harness 151. The volume-side harness 154 is connected to the second harness 152. The third harness 153 extends from the ignition unit (ignition coil) 204 (FIG. 10) housed in the plug cap 60 (FIG. 2). The main-switch-side harness 155 is connected to the third harness 153. The relay harness 156 is relayed to the first harness 151.

The first through third harnesses 151 through 153, the volume-side harness 154, the main-switch-side harness 155, and the relay harness 156 constitute electrical wiring. The first through third harnesses 151 through 153 have plugs 161 through 163, respectively, at the distal ends thereof. The volume-side harness 154 has a socket 164 at the distal end thereof. The main-switch-side harness 155 has a socket 165 at the distal end thereof. The relay harness 156 has a socket 166.

Figure 7B:
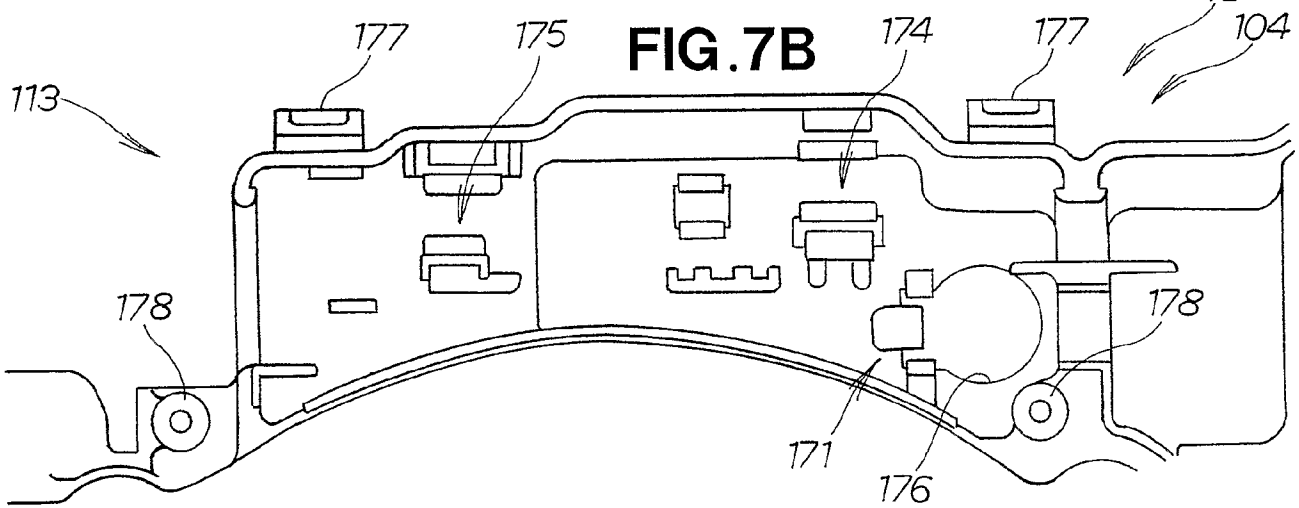
FIG. 7B is a plan view of the first connector terminal in a state in which the electrical wiring is enclosed.

As shown in FIG. 7B, the first connector housing 113 has a first retainer 171 for retaining the plug 161 of the first harness 151 (FIG. 7A), a volume-side retainer 174 for retaining the socket 164 of the volume-side harness 154, a switch-side retainer 175 for retaining the socket 165 of the main-switch-side harness 155, a hole 176 through which the relay harness 156 is inserted, engaging units (engaging tabs) 177 and 177 for locking the cover panel 53 (FIG. 5), and locking bosses 178 and 178 for fastening the cover panel 53.

Figure 8A:
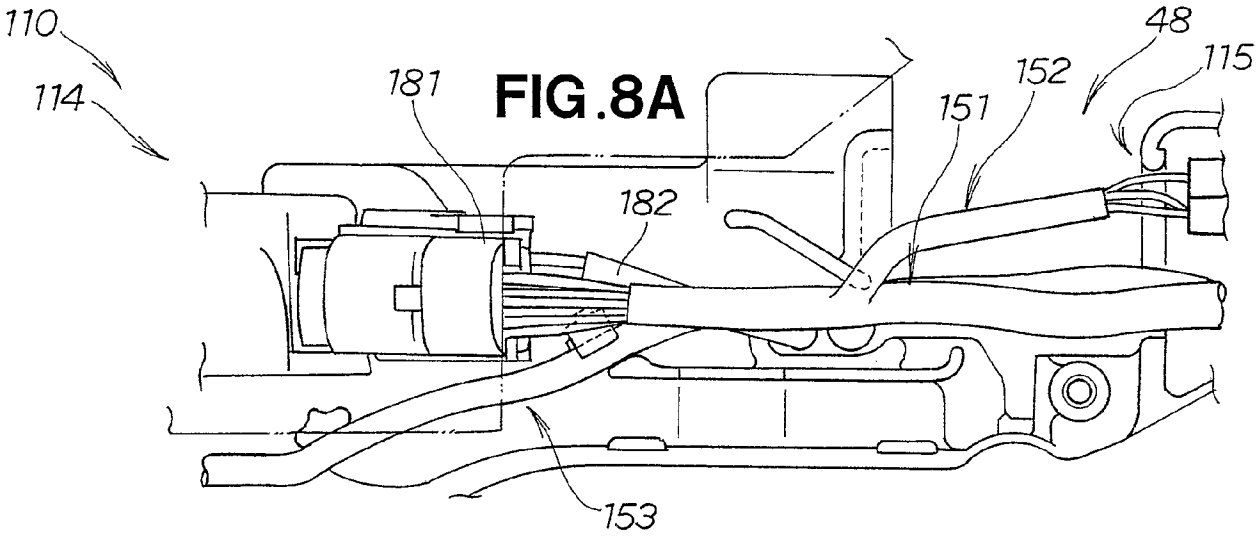
FIG. 8A is a plan view showing only the second connector terminal.

As shown in FIG. 8A, the first harness 151 has a plug 181 at the other end thereof. A separate harness 182 extends from the plug 181. The third harness 153 passes through the open portion 115 and the second connector housing 114.

Figure 8B:
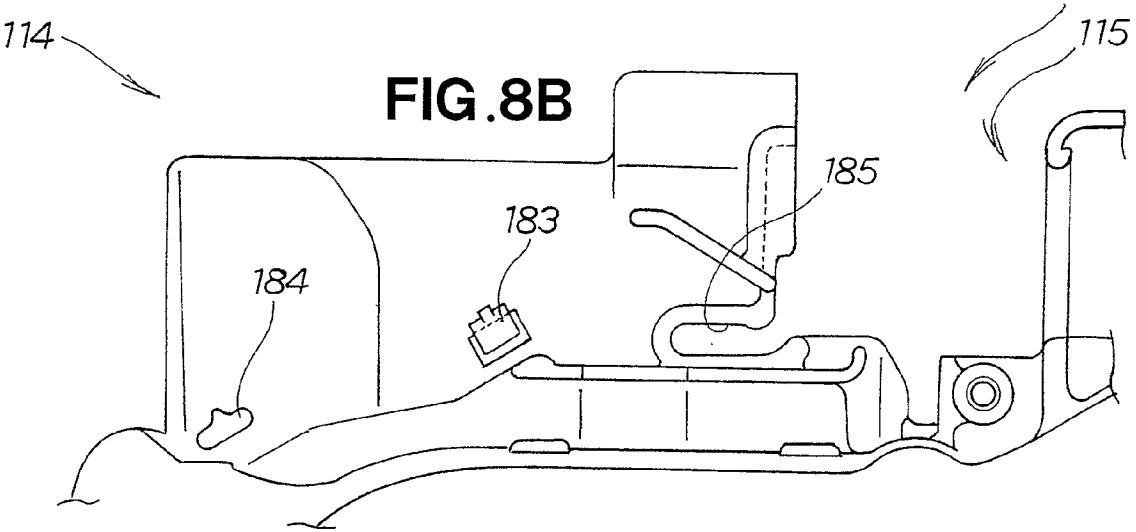
FIG. 8B is a view of the second connector terminal in a state in which the electrical wiring is enclosed.

As shown in FIG. 8B, the second connector housing 114 has retainer 183 that is shaped as an L in cross section and that supports the third harness 153, and an I-type retainer 184 for supporting the third harness 153.

The second connector housing 114 has a notch 185 that opens toward the open portion 115, for retaining the separate harness 182 (FIG. 8A).

Figure 9A:
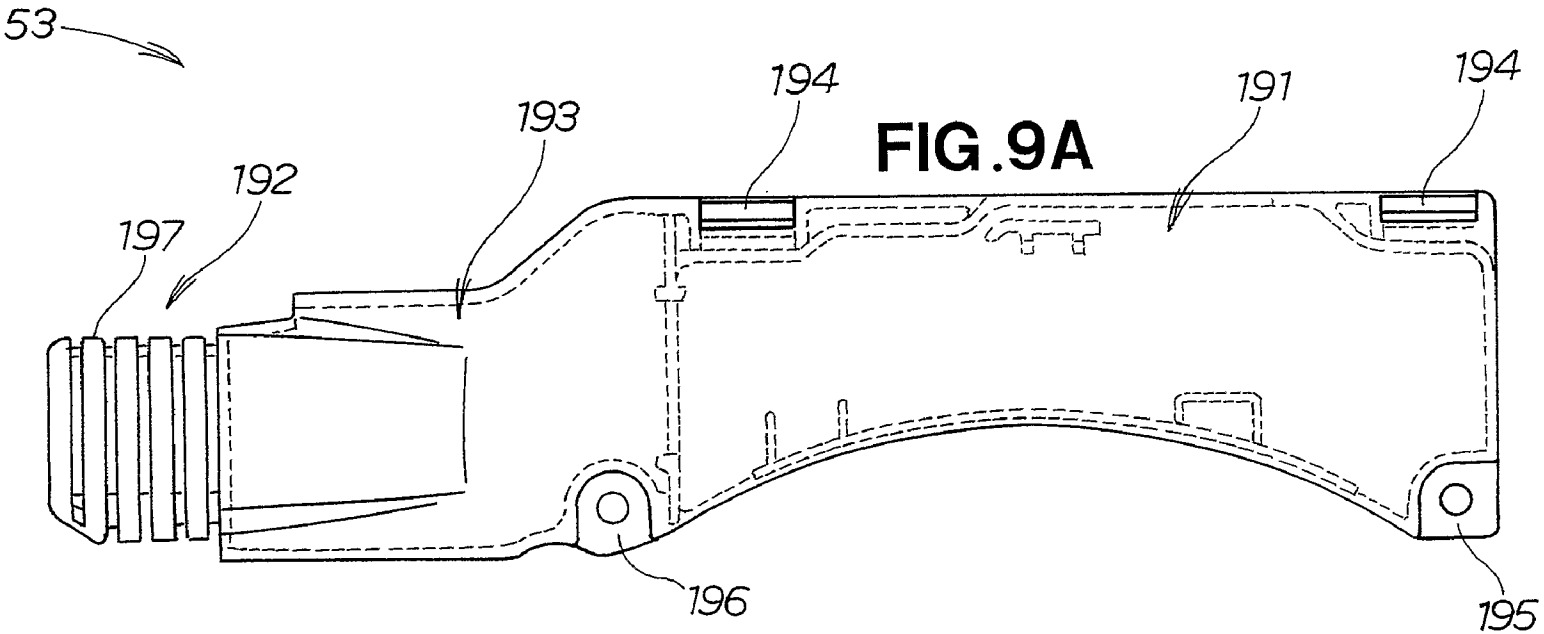
FIG. 9A is a front view of the cover panel.
Figure 9B:
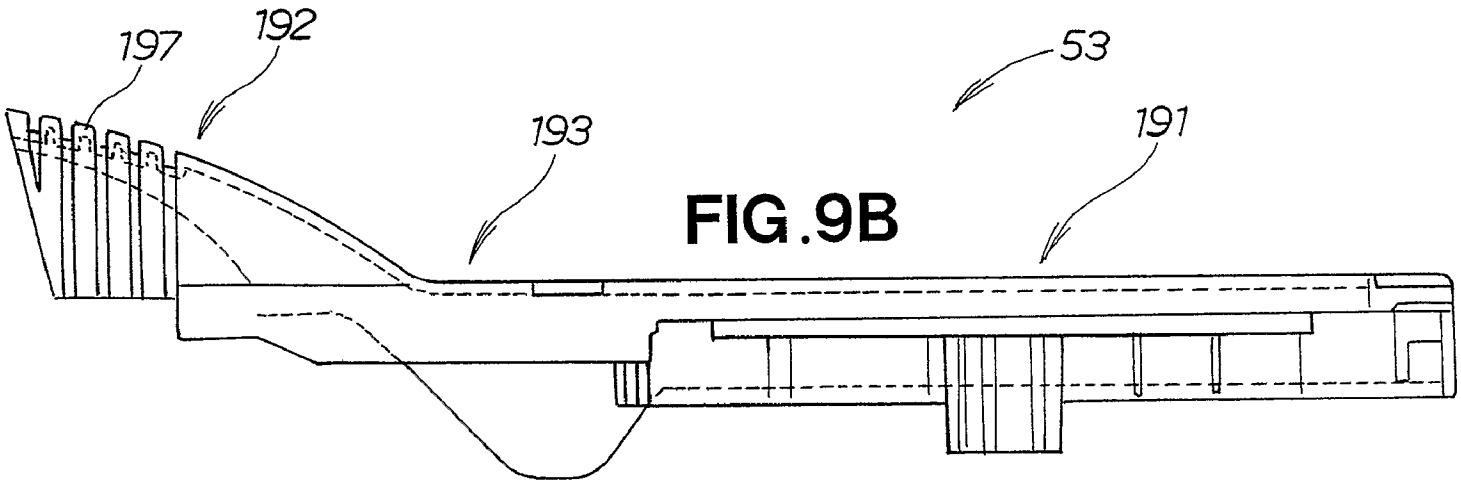
FIG. 9B is a plan view of the cover panel.

As shown in FIGS. 9A and 9B, the cover panel 53 is composed of a first cover unit 191 that is covered by the first connector housing 113 (FIG. 6), an open cover unit 193 for covering the open unit 115 (FIG. 8B), and a second cover unit 192 for covering the second connector housing 114, and these cover units are integrally formed.

The first cover unit 191 has engaging holes 194 and 194 into which the engaging tabs 177 and 177 (FIG. 7B) are locked, and a locking unit 195 that corresponds to one of the locking bosses 178 (FIG. 7B). The open cover unit 193 has a locking unit 196 that corresponds to the other locking boss 178.

As shown in FIG. 9B, the second cover unit 192 has an expanded portion 197 that is expanded to the outside from the engine main body 27 (FIG. 1) and that covers the plug 181 mounted to the other end of the first harness 151 (FIG. 8A).

Figure 10:
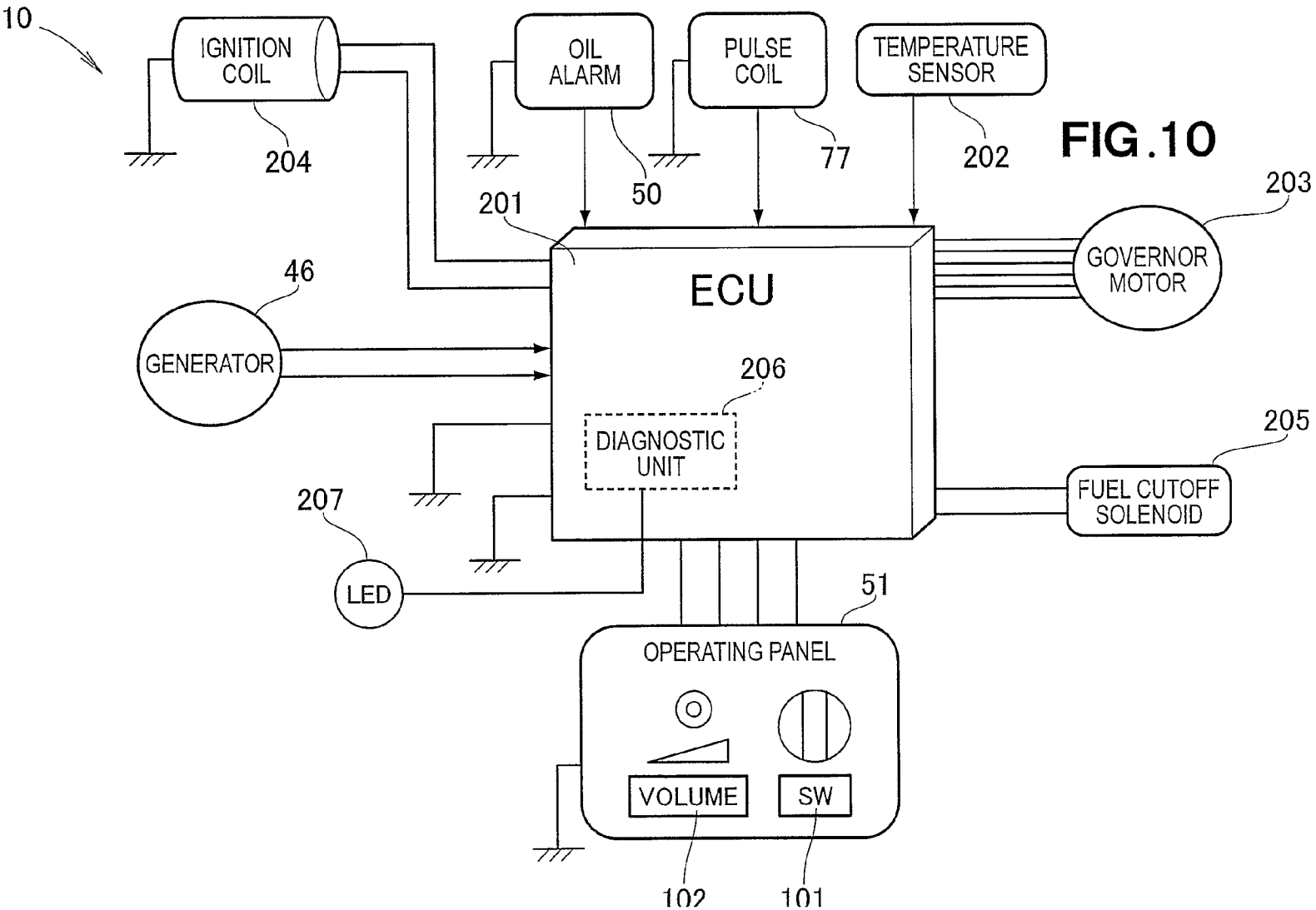
FIG. 10 is a control block diagram of the multipurpose engine shown in FIG. 1.

As shown in FIG. 10, the electrical power generated by the generator 46 is fed to an Electronic Controlled Unit (ECU) 201.

The following types of information are received in the ECU 201: the oil level information outputted from the oil level detection device (oil alarm) 50, the information from the pulse coil (rotation detection sensor) 77 for detecting the revolutions of the generator 46, and the information from a temperature sensor 202 for detecting the temperature of the cylinder block 15 (FIG. 1). The state of the main switch 101 is determined and the information from the volume 102 for adjusting the characteristics of the governor motor 203 provided to the carburetor 36 (FIG. 2) is received.

The ECU 201 sends ignition information to the ignition coil 204 provided to the plug cap 60 (FIG. 2), sends throttle opening information to the governor motor 203, and sends drive information to a fuel cutoff solenoid 205 for stopping the supply of fuel.

The ECU 201 also includes a diagnostic unit 206 for diagnosing failures. The diagnostic results from this diagnostic unit 206 are displayed by a Light Emitting Diode (LED) 207.

The generator 46, ECU 201, oil alarm 50, pulse coil 77, ignition coil 204, and fuel cutoff solenoid 205 are all electrical components.

Figure 11A:
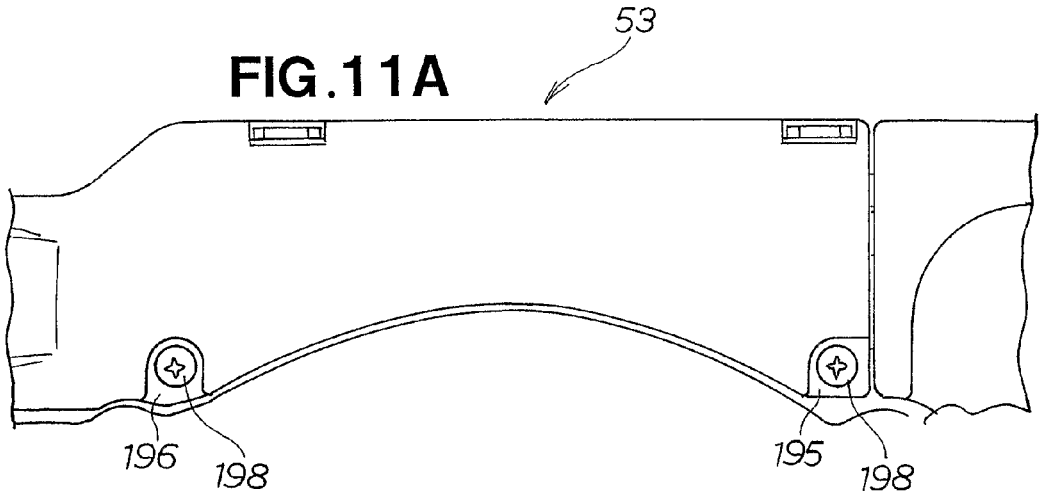
FIG. 11A is a diagram depicting a state in which the cover panel is attached in the multipurpose engine shown in FIG. 1.

The design properties of the multipurpose engine 10 (FIG. 3) can be enhanced by covering the harnesses (electrical wiring) 151 through 156 (FIG. 11B) as shown in FIG. 11A. The harnesses 151 through 156 can also be prevented from being inadvertently touched, and the reliability of the multipurpose engine 10 can be enhanced. The cover panel 53 is mounted to the fan cover 48 (FIG. 11B) by mounting screws 198 and 198.

Figure 11B:
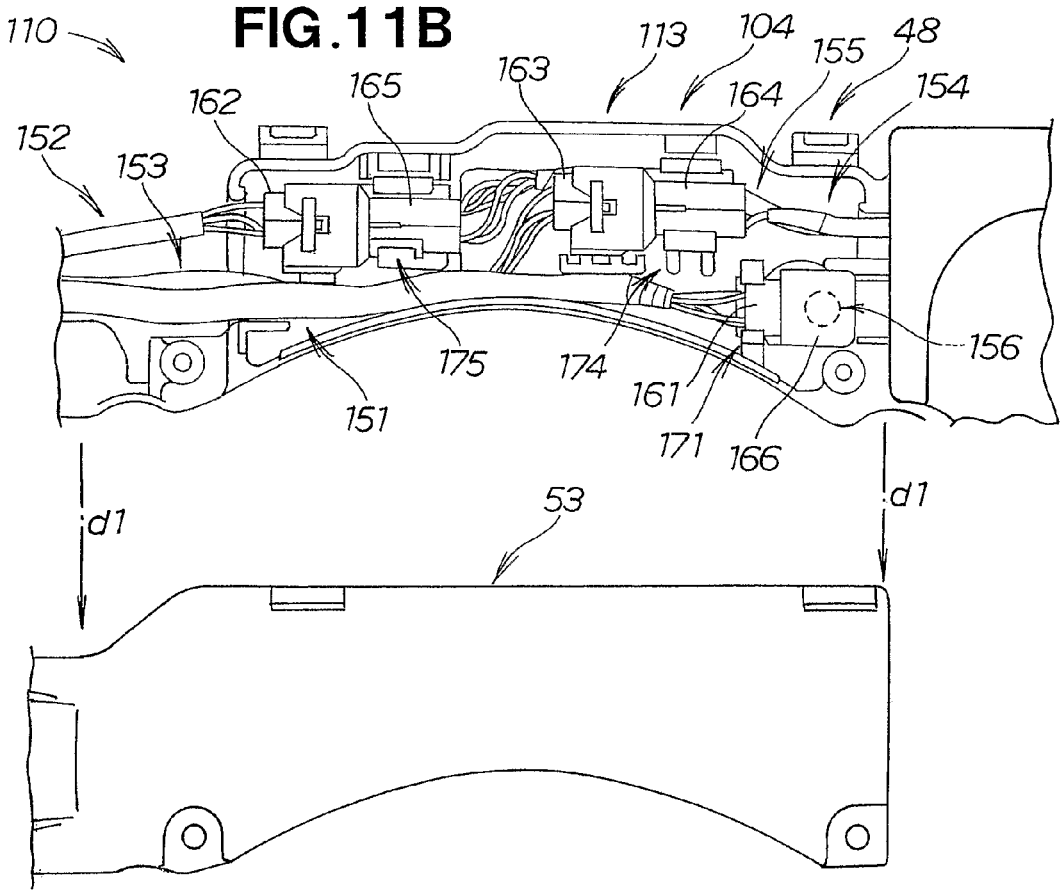
FIG. 11B is a diagram depicting a state in which the cover panel is removed in the multipurpose engine shown in FIG. 1.

Removing the cover panel 53 from the fan cover 48 as indicated by the arrows dl and dl in FIG. 11B exposes the open portion 115 and the first and second connector housings 113 and 114 (FIG. 6) that constitute the connector box 104. This makes it possible to focus maintenance on the electrical system of the multipurpose engine 10.

The electrical wiring is usually provided to the dead space between the cylinder block and the fuel tank, air cleaner, fuel tank, and other auxiliary components in order to protect the electrical wiring. However, since compactness is desired in the multipurpose engine, the space between the cylinder block and the fuel tank, air cleaner, fuel tank, and other auxiliary components is narrow, and the electrical wiring is difficult to connect through this space.

In the electrical wiring structure 110 of the multipurpose engine, connectors composed of plugs and sockets 161 through 166 for interconnecting the harnesses 151 through 156 are provided to the harnesses. Since the connector box 104 in which the harnesses 151 through 156 are housed is provided to the side of the cylinder block 15, and the harnesses 151 through 156 are interconnected inside the connector box 104, the connections between the governor motor 203, volume 102, or other electrical components shown in FIG. 10 can be concentrated inside the connector box 104. As a result, the electrical components can be made easier to maintain, and repairs can be performed quickly.

The connector box 104 is disposed adjacent to the switch knob 54 by which the main switch 101 can be operated, to the adjustment knob 55 (FIG. 5) by which the volume 102 can be operated, and to other operating members. It is therefore possible to verify the condition of the harnesses 151 through 156 while confirming the functioning of the operating members. As a result, convenience during maintenance can be enhanced.

Furthermore, by providing retainers 171, 174, and 175 for supporting the harnesses 151 through 156 in the connector box 104, the harnesses 151 through 156 can easily be prevented from vibrating. As a result, the connections between the harnesses 151 through 156 can be made more reliable.

Figure 12:
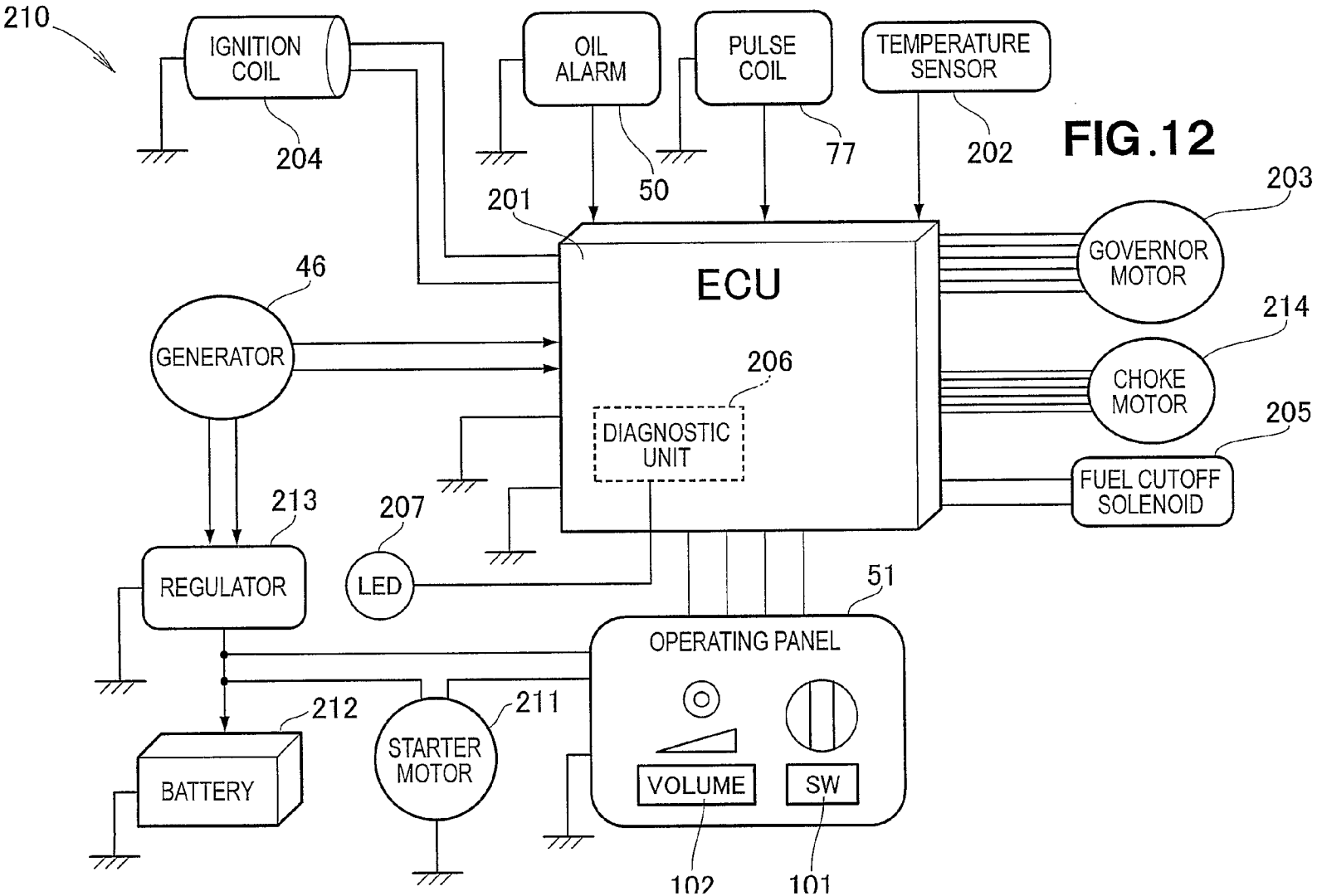
FIG. 12 is a control block diagram of the multipurpose engine according to another embodiment.
Figure 13:
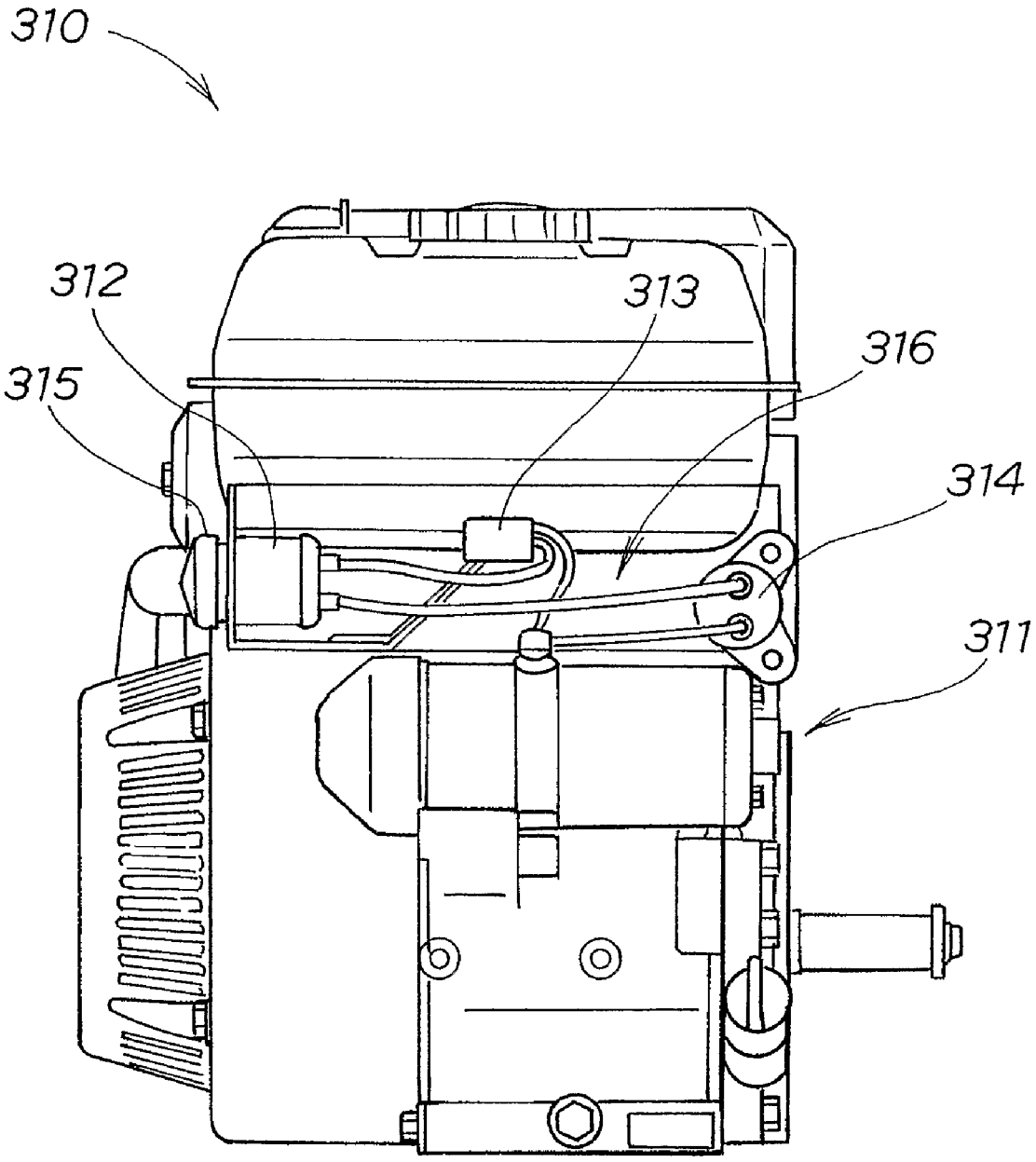
FIG.13 (PRIOR ART)
FIG. 13 is a diagram depicting the conventional basic configuration.

FIG. 12 shows an electrical block diagram relating to the multipurpose engine according to another example.

The multipurpose engine 210 is provided with a starter motor 211 for starting the engine main body, a battery 212 for supplying power to this starter motor 211, a regulator 213 interposed between the generator 46 and the battery 212, and a choke motor 214 for automatically withdrawing a choke (not shown in the drawing) during startup. The ECU 201 has a port for connecting the choke motor 214.

As described above, an example is given herein in which the connector box 104 has a first connector housing 113 and a second connector housing 114, and an open portion 115 is interposed between these first and second connector housings 113 and 114. However, the present invention is not limited by this example, and may also be configured so as to have only the first connector housing.

INDUSTRIAL APPLICABILITY

A connector for interconnecting parts of electrical wiring is provided to the wiring itself, a connector box for housing the electrical wiring is provided beside the engine main body, and parts of the electrical wiring are interconnected inside the connector box. The present invention is therefore useful particularly in a small multipurpose engine.

The invention claimed is:

1. A multipurpose engine comprising:

an engine main body;

a generator operated by the driving force of the engine;

auxiliary components comprising a fuel tank, an air cleaner, and a muffler disposed on a top surface the engine main body;

an electrical component comprising a starter, and a main switch; and a plurality of electrical wirings for connecting the generator and the electrical component to each other, wherein each of the plurality of electrical wirings is connected inside a connector box provided to the side of the engine main body and disposed in a gap defined directly between the generator and the fuel tank.

2. The multipurpose engine of claim 1, wherein the connector box is provided in a position that is adjacent to an operating panel on which the main switch is mounted.

3. The multipurpose engine of claim 1, wherein retainers for retaining the plurality of electrical wirings are provided to the connector box.

4. The multipurpose engine of claim 1, further comprising:

a cooling fan provided coaxially with the output shaft of the engine main body; and a fan cover provided to the engine main body so as to cover the cooling fan, wherein the fan cover is integrally formed with the connector box.

* * * * *